US007048064B1

(12) United States Patent
Smith

(10) Patent No.: US 7,048,064 B1
(45) Date of Patent: May 23, 2006

(54) MULTI-UNIT CENTRALIZER

(76) Inventor: Larry W. Smith, 12879 CR 3300, Brownsboro, TX (US) 75756

( * ) Notice: Subject to any disclaimer, the term of this patent is extended or adjusted under 35 U.S.C. 154(b) by 138 days.

(21) Appl. No.: 10/662,203

(22) Filed: Sep. 12, 2003

(51) Int. Cl.
*E21B 17/10* (2006.01)

(52) U.S. Cl. ..... 166/382; 166/241.17; 175/325.4; 175/325.7

(58) Field of Classification Search ..... 166/277, 166/381, 378, 382, 241.6, 241.7, 241.1; 175/325.1, 175/325.4, 325.5, 325.6, 325.7
See application file for complete search history.

(56) References Cited

U.S. PATENT DOCUMENTS

| | | | | | |
|---|---|---|---|---|---|
| 2,252,978 | A | * | 8/1941 | Parkin | 175/325.6 |
| 2,389,906 | A | * | 11/1945 | Heard | 166/241.2 |
| 2,657,907 | A | * | 11/1953 | Cochran et al. | 175/325.4 |
| 2,789,870 | A | * | 4/1957 | Hanes | 175/325.7 |
| 2,813,697 | A | * | 11/1957 | Swart | 175/325.4 |
| 2,973,996 | A | * | 3/1961 | Self | 175/325.7 |
| 3,292,708 | A | * | 12/1966 | Mundt | 166/241.6 |
| 3,370,894 | A | | 2/1968 | Pourchot | 308/4 |
| 3,447,839 | A | * | 6/1969 | Salvatori | 175/325.4 |
| 3,680,646 | A | * | 8/1972 | Hughes et al. | 175/323 |
| 3,963,075 | A | * | 6/1976 | Evans | 166/241.6 |
| 4,076,084 | A | * | 2/1978 | Tighe | 175/73 |
| 4,099,564 | A | | 7/1978 | Hutchison | 166/241 |
| 4,106,823 | A | * | 8/1978 | Bassinger | 175/325.4 |
| 4,190,124 | A | * | 2/1980 | Terry | 175/406 |
| 4,428,626 | A | * | 1/1984 | Blau et al. | 175/325.4 |
| 4,520,869 | A | | 6/1985 | Svenson | 166/241 |
| 5,027,914 | A | * | 7/1991 | Wilson | 175/406 |
| 5,487,426 | A | * | 1/1996 | O'Hair | 166/378 |
| 5,740,862 | A | | 4/1998 | Sable | 166/241.2 |
| 5,881,810 | A | | 3/1999 | Reinholdt | 166/241.7 |
| 6,102,118 | A | | 8/2000 | Moore | 166/241.7 |
| 6,283,205 | B1 | | 9/2001 | Cannon | 166/241.1 |
| 6,367,556 | B1 | | 4/2002 | Moore | 166/378 |
| 6,435,275 | B1 | | 8/2002 | Kirk et al. | 166/241.1 |
| 6,464,013 | B1 | | 10/2002 | Bystedt | 166/380 |
| 6,516,877 | B1 | | 2/2003 | Terry | 166/241.2 |

* cited by examiner

*Primary Examiner*—Jennifer H. Gay
(74) *Attorney, Agent, or Firm*—R. Keith Harrison

(57) ABSTRACT

A multi-unit centralizer for centralizing or otherwise positioning a tubing string in a well bore. The centralizer has a centralizer hub including multiple hub subunits for removably engaging each other and at least one spacer lug for removably engaging each of the hub subunits.

26 Claims, 3 Drawing Sheets

MULTI-UNIT CENTRALIZER

FIELD OF THE INVENTION

The present invention relates to centralizers for centering a tubing string in a well bore. More particularly, the present invention relates to a multi-unit centralizer which is easy to assemble and disassemble on a tubing string and is adaptable to tubing strings of various design.

BACKGROUND OF THE INVENTION

In water wells, oil wells and gas wells, a subterranean well bore extends beneath the ground to a supply of water, oil or gas which is extracted to the ground surface, typically to supply a home or business. A well casing typically lines the well bore. The water, oil or gas is pumped from the subterranean source to the ground surface through a tubing string which extends downwardly through the well bore. The tubing string typically includes multiple subunits which are connected to each other by couplings in the assembled tubing string.

In positioning the tubing string in the well bore, it is frequently desirable to maintain the tubing string in the center of the bore, or at least spaced from the well casing or interior well surface, to facilitate unhindered passage of packing material, for example, into the well, between the casing or interior surface of the well and the tubing string. For this purpose, centralizers having outwardly-extending projections are frequently placed on the tubing string to contact the well casing or interior surface of the well and maintain the tubing string typically in the approximate center of the well bore. However, many centralizers of conventional design are difficult to assemble on the tubing string in the field. Thus, a centralizer is need which is versatile and is easy to assemble in place on a tubing string.

SUMMARY OF THE INVENTION

The present invention is generally directed to a multi-unit centralizer having a centralizer hub which includes multiple hub subunits that are placed around a tubing string. At least one spacer lug removably engages each hub subunit and extends outwardly therefrom to contact the interior surface or casing of a water, oil or gas well bore and position the tubing string in a central or off-center position in the bore as the tubing string is extended into the bore. The centralizer may include multiple, interchangeable spacer lugs of various sizes and a selected one or ones of which can be removably fitted on a corresponding one of the hub subunits, depending on the size of the well bore or casing in which the tubing string is to be centralized or otherwise positioned.

BRIEF DESCRIPTION OF THE DRAWINGS

The invention will now be described, by way of example, with reference to the accompanying drawings, in which.

DETAILED DESCRIPTION OF THE INVENTION

The present invention is generally directed to a multi-unit centralizer which is assembled on a tubing string to centralize or otherwise position the tubing string in a desired location with respect to the interior surface or casing of a subterranean well bore. The multi-unit centralizer is particularly suitable for centralizing or positioning a tubing string in a subterranean water well for the extraction of water from the well to the ground surface. However, the multi-unit centralizer is equally adaptable to centralizing or positioning tubing strings in oil or gas wells for the extraction of oil or gas, respectively, to the ground surface.

Figure 1:
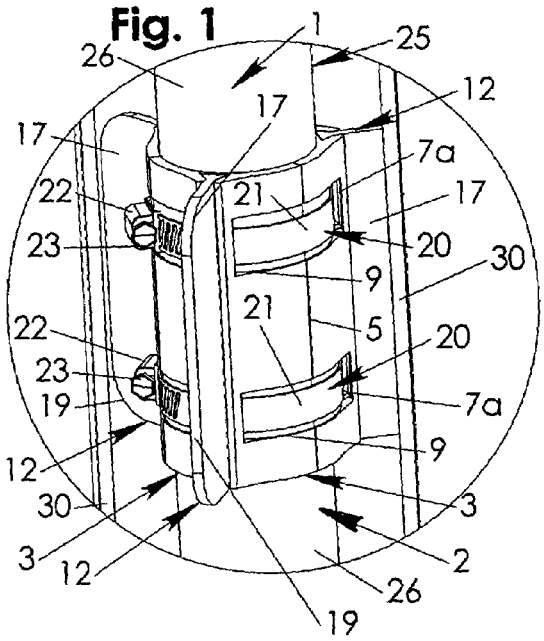
FIG. 1 is an enlarged perspective view of an illustrative embodiment of the multi-unit centralizer of the present invention, taken at the circle labeled "1" shown in FIG. 2.
Figure 2:
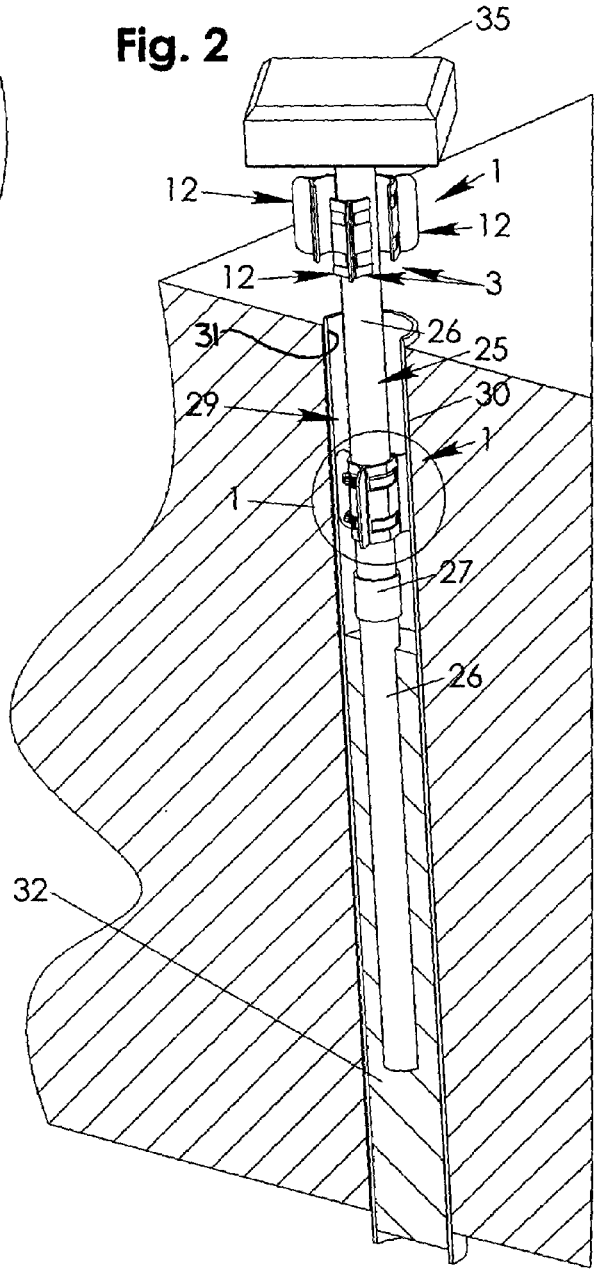
FIG. 2 is a perspective view of a tubing string extending into a subterranean well bore (in section), with one multi-unit centralizer of the invention assembled on the tubing string and positioned in the well bore and a second multi-unit centralizer being assembled on the tubing string above the well bore and beneath a rotary table (shown schematically) used to assemble the tubing string typically in conventional fashion.
Figure 3:
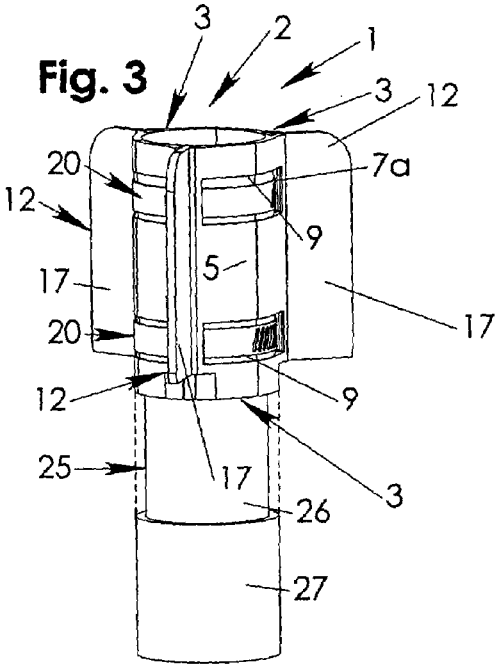
FIG. 3 is a perspective view of a multi-unit centralizer of the present invention, assembled on a tubing string (partially in section)

Referring initially to FIGS. 1–3 of the drawings, an illustrative embodiment of the multi-unit centralizer of the present invention is generally indicated by reference numeral 1. The multi-unit centralizer 1 includes a multi-piece centralizer hub 2 that is assembled from at least three substantially similar or identical hub subunits 3, as illustrated in FIGS. 1 and 3 and hereinafter described in detail. At least one spacer lug 12 is removably attached to each of the hub subunits 3, as will be hereinafter described. The hub subunits 3 and spacer lugs 12 may be a plastic such as PVC (polyvinyl chloride), in non-exclusive particular, or may alternatively be a metal or other suitable material.

Briefly, as shown in FIGS. 1 and 2, the multi-unit centralizer 1 is assembled on a tubing string 25 which is then lowered into a subterranean well bore 29 to extract water, oil or gas from the well bore 29. The multi-unit centralizer 1 centralizes the tubing string 25, or alternatively, positions the tubing string 25 in a selected off-center location, with respect to a well casing 30 or interior surface of the well bore 29, as needed. Accordingly, an annulus 31 is defined between the tubing string 25 and the well casing 30 or interior surface of the well bore 29 to facilitate the passage of packing material 32, for example, into the well bore 29, as will be hereinafter described in detail.

Figure 12:
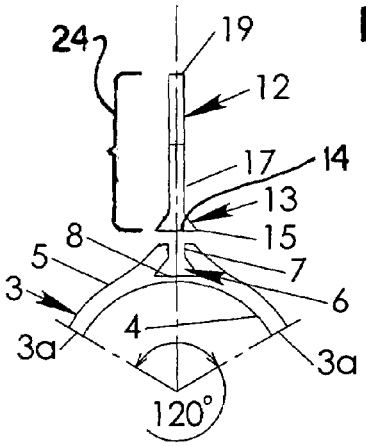
FIG. 12 is a top view of a hub subunit of an illustrative embodiment of the multi-unit centralizer, illustrating a dovetail flange provided on a spacer lug for slidably and removably engaging a companion-shaped dovetail flange groove provided in the hub subunit.

Referring next to FIGS. 4 and 12–16, each hub subunit 3 of the centralizer hub 2 includes a concave inner surface 4 and a convex outer surface 5, as illustrated in FIG. 12. The curvature of the concave inner surface 4 substantially matches the outer curvature of the tubing string 25 (FIG. 2) which is to be centralized or otherwise positioned in the well bore 29. Accordingly, because the diameters of tubing strings 25 vary, the curvature of the concave inner surface 4 of each hub subunit 3 will vary depending on the particular application. As further illustrated in FIG. 12, in the case of the centralizer hub 2 having three hub subunits 3, the opposite edges 3*a* of each hub subunit 3 are typically disposed at an angle of about 120 degrees with respect to each other.

Figure 4:
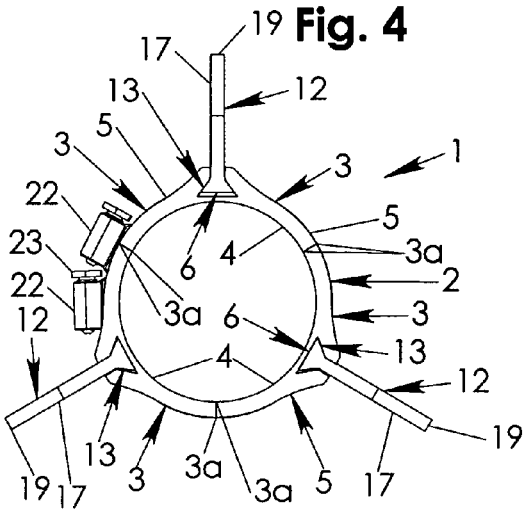
FIG. 4 is a top view of an illustrative embodiment of an assembled multi-unit centralizer of the present invention, fitted with three spacer lugs of equal size.
Figure 16:
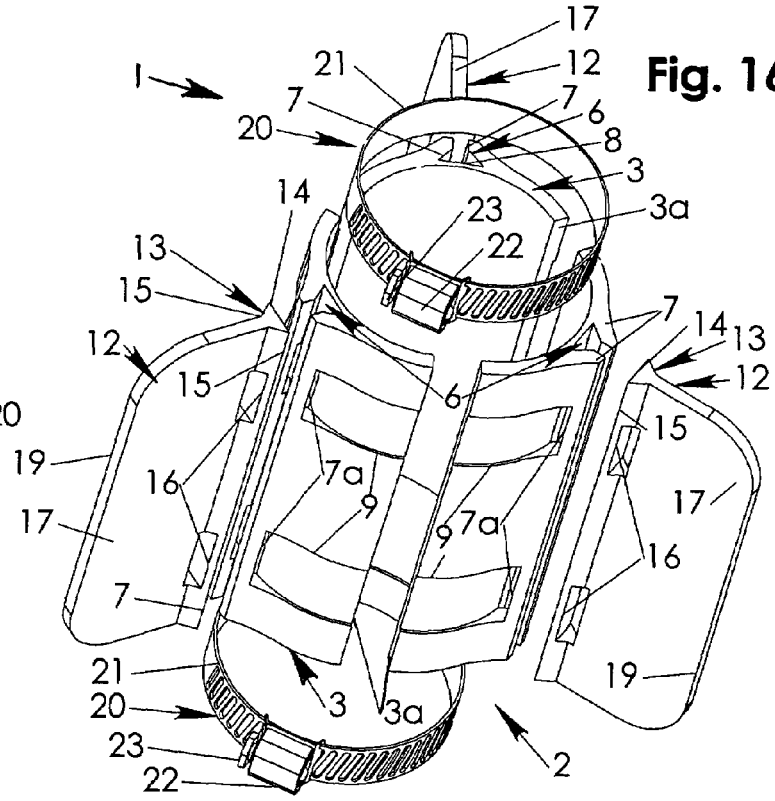
FIG. 16 is an exploded, perspective view of a multi-unit centralizer of the present invention.

As further illustrated in FIG. 12, at least one elongated dovetail flange groove 6 having at least one open end (not labeled) extends longitudinally along each hub subunit 3 and is defined typically by and between a pair of inwardly-facing, adjacent slot flanges 7 that extend from the convex outer surface 5. A flat slot seat 8 typically extends between the slot flanges 7 in each flange groove 6. As illustrated in FIG. 16, each spacer lug 12 includes an elongated, generally rectangular lug blade 17 having an outer edge 19. A dovetail lug flange 13 typically defines the opposite, inner or attachment edge of the lug blade 17. As illustrated in FIG. 12, the lug flange 13 typically includes a pair of flange wings 15 which project outwardly from the respective planar surfaces of the lug blade 17 and extend along the longitudinal dimension of the hub subunit 3. A flat flange face 14 is coextensive with and extends between the flange wings 15. Accordingly, each spacer lug 12 is removably attached to the corresponding hub subunit 3 typically by inserting the attachment edge of the lug blade 17 in an open end of the companion flange groove 6 of the hub subunit 3 and then slidably inserting the lug flange 13 of the spacer lug 12 in the companion flange groove 6 of the hub subunit 3 in a direction which is parallel to a longitudinal axis of the centralizer hub 2 or along a longitudinal axis of the hub subunit 3. This causes the flange face 14 of the lug flange 13 to engage the flat slot seat 8 of the flange groove 6 and the flange wings 15 of the lug flange 13 to engage the respective slot flanges 7 of the flange groove 6, as illustrated in FIG. 4.

It will be appreciated by those skilled in the art that two or more of the flange grooves 6 may be provided in each of the hub subunits 3 to facilitate removable attachment of a corresponding number of multiple spacer lugs 12 on each hub subunit 3. It is understood that each flange groove 6 and interlocking lug flange 13 may have a configuration which departs from the description provided hereinabove, and those elements may have any suitable complementary or interlocking configuration which is suitable for removably attaching each spacer lug 12 on the corresponding hub subunit 2. It is further understood that the present invention contemplates techniques other than the flange groove 6 and mating lug flange 13 to removably interlock and mount each spacer lug 12 on the corresponding hub subunit 3, as this purpose may be accomplished using any suitable technique known by those skilled in the art.

Figure 14:
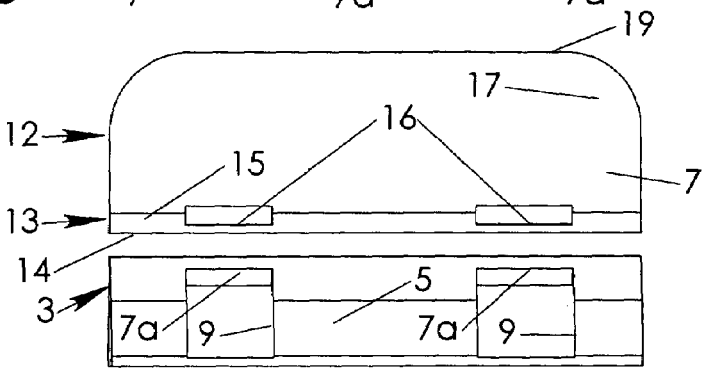
FIG. 14 is an exploded side view of a hub subunit and spacer lug elements of the multi-unit centralizer, illustrating removable engagement of the spacer lug with the hub subunit.
Figure 15:
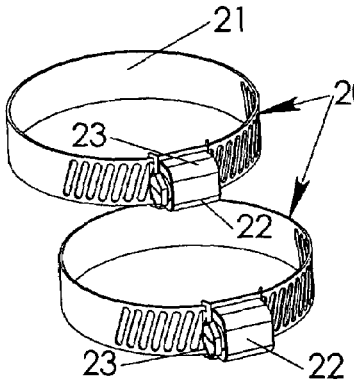
FIG. 15 is a perspective view of a pair of band clamps suitable for assembling the multi-unit centralizer.

As illustrated in FIG. 16 and hereinafter further described, the multiple hub subunits 3 are held together in the centralizer hub 2, and the spacer lugs 12 are removably secured to the respective hub subunits 3 of the centralizer hub 2, typically using a pair of standard or conventional, circular band clamps 20, although these purposes may be achieved using alternative techniques known by those skilled in the art. As illustrated in FIG. 15, each of the band clamps 20 may include an elongated, flexible, typically metal band 21 provided with a fastener socket 22 that receives a threaded fastener 23. As particularly illustrated in FIGS. 13, 14 and 16, each of a pair of spaced-apart, elongated, generally parallel clamp grooves 9 is provided in the outer surface 5 of each hub subunit 3. As illustrated in FIG. 14, registering band slots 7*a* extend through the respective slot flanges 7 of each hub subunit 3 and are disposed in registering relationship to the respective clamp grooves 9. As further illustrated in FIG. 14, each of a pair of spaced-apart clamp slots 16 extends typically through the lug flange 13 of each spacer lug 12. Accordingly, when the lug flange 13 of each spacer lug 12 is slidably inserted in the companion flange groove 6 of the corresponding hub subunit 3, the clamp slots 16 in the lug flange 13 register with the respective band slots 7*a* and clamp grooves 9 of the hub subunit 3. This slot-groove alignment or registration facilitates extension of the band 21 of each band clamp 20 through the appropriate set of clamp grooves 9 and registering band slots 7*a* and clamp slots 16, respectively, to both removably secure the hub subunits 3 together in the assembled centralizer hub 2 and removably secure each spacer lug 12 on the corresponding hub subunit 3. When the hub subunits 3 are held together by the band clamps 20 in the assembled hub 2, the edges 3*a* of adjacent hub subunits 3 abut against each other, as illustrated in FIG. 4.

Referring next to FIGS. 4–11 of the drawings, it will be appreciated by those skilled in the art that the centralizer hub 2 may be fitted with interchangeable spacer lugs 12 of various sizes depending on the size of the annulus 31 (FIG. 5) between the tubing string 25 and the interior surface of the well bore 29 or well casing 30. As illustrated in FIG. 12, the spacer lugs 12 may vary in size among each other according to the radial dimension 24, or distance between the outer edge 19 and the lug flange 13, of each. For example, as illustrated in FIGS. 8–11, the centralizer hub 2 may be fitted with relatively large spacer lugs 12*a* (FIG. 11), each having a large lug blade 17*a*; relatively small spacer lugs 12*c* (FIG. 9), each having a small lug blade 17*c*; or medium spacer lugs 12*b* (FIG. 10), each having a medium-sized lug blade 17*b*. The large spacer lugs 12*a*, medium spacer lugs 12*b* and small spacer lugs 12*c* may represent parts of a continuum of possible sizes for the spacer lugs 12. The spacer lugs 12 of various sizes are interchangeable with each other on the centralizer hub 2 and are selected according to the size of the spacer lugs 12 needed to adequately centralize or otherwise position the tubing string 25 in the well bore 29.

Figure 6:
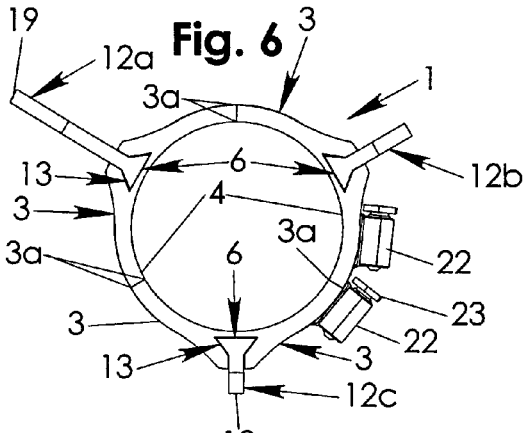
FIG. 6 is a top view of an assembled multi-unit centralizer, fitted with three spacer lugs of unequal size.
Figure 7:
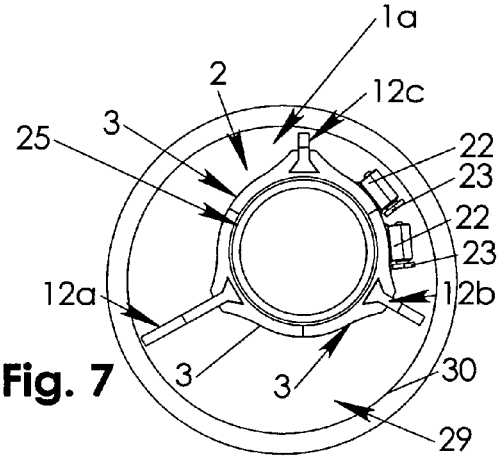
FIG. 7 is a top view of a tubing string positioned in a well bore, with the multi-unit centralizer of FIG. 6 assembled on the tubing string and positioning the tubing string in an off-center position in the well bore.

As illustrated in FIGS. 6 and 7, it will further be appreciated by those skilled in the art that spacer lugs 12 of various sizes may be provided on the same centralizer hub 2 to position the tubing string 25 in an off-center location in the well bore 29, as deemed necessary. For example, a large spacer lug 12*a*, a medium spacer lug 12*b* and a small spacer lug 12*c* may be provided on the centralizer hub 2, as illustrated in FIG. 6, to engage the interior surface of the well casing 30 and position the tubing string 25 in an off-center or non-central location in the well bore 29, as illustrated in FIG. 7.

In typical application of the invention, one or multiple multi-unit centralizers 1 are assembled on a tubing string 25, which is then lowered into a subterranean well bore 29 that is typically lined with a well casing 30, as illustrated in FIG. 2. Accordingly, the tubing string 25 is assembled from multiple tubing string segments 26, adjacent ones of which are connected to each other by a coupling 27. A rotary table 35 may be positioned above the well bore 29 to assemble the tubing string segments 26 into the tubing string 25 and lower the assembled tubing string 25 into the well bore 29, typically in conventional fashion.

Figure 8:
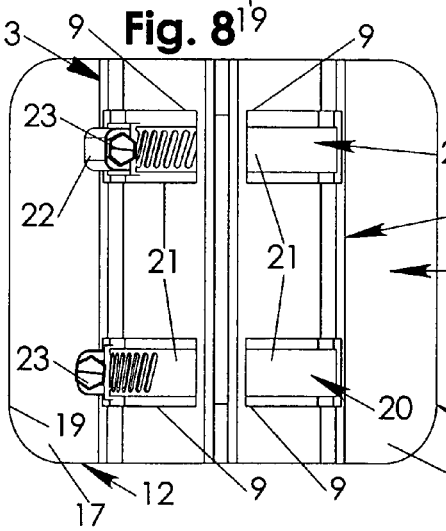
FIG. 8 is a side view of the assembled multi-unit centralizer.
Figure 9:
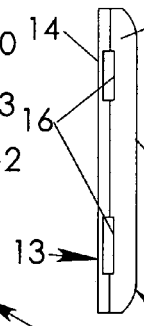
FIG. 9 is a side view of a small-sized, interchangeable spacer lug for the multi-unit centralizer.
Figure 10:
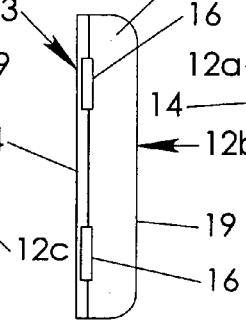
FIG. 10 is a side view of a medium-sized, interchangeable spacer lug for the multi-unit centralizer.
Figure 11:
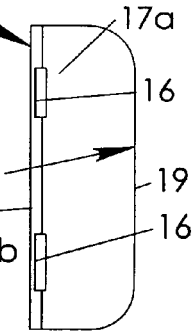
FIG. 11 is a side view of a large-sized, interchangeable spacer lug for the multi-unit centralizer.
Figure 13:
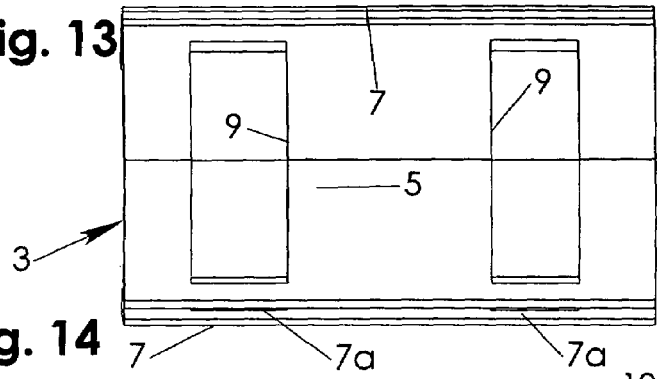
FIG. 13 is an exterior view of a pair of hub subunits of the multi-unit centralizer.

As further illustrated in FIG. 2, each multi-unit centralizer 1 may be assembled on the tubing string 25 beneath the rotary table 35 and above the well bore 29. Accordingly, assembly of the multi-unit centralizer 1 is begun typically by initially attaching the spacer lugs 12 to the respective hub subunits 3. This is accomplished typically by slidably inserting the dovetail lug flange 13 of each spacer lug 12 into the companion dovetail flange groove 6 of the hub subunit 3, as illustrated in FIG. 12, and aligning the clamp slots 16 of the spacer lug 12 with the respective band slots 7*a* and clamp grooves 9 of the hub subunit 3, as illustrated in FIG. 14. Next, as illustrated in FIG. 2, the hub subunits 3, each with at least one spacer lug 12 attached thereto, are placed around the tubing string 25 and fastened to each other typically using the pair of band clamps 20. This is accomplished by detaching one end of the band 21 of each band clamp 20 from the fastener socket 22; extending the band 21 through the corresponding set of clamp grooves 9 and band slots 7*a* in the hub subunits 3 and registering clamp slots 16 in the respective spacer lugs 12; re-inserting the free end of the band 21 back into the fastener socket 22; and rotating the fastener 23 in the fastener socket 22 to tighten the band 21 and firmly seat the band clamps 20 in the corresponding set of clamp grooves 9 of the hub subunits 3, as illustrated in FIG. 8. As the band 21 of each band clamp 20 is tightened against the hub subunits 3 by rotation of the fastener 23, the edges 3*a* of adjacent hub subunits 3 firmly abut against each other in the assembled centralizer hub 2, as illustrated in FIG. 4. Accordingly, the band clamps 20 both secure the hub subunits 3 together and secure the spacer lugs 12 to the respective hub subunits 3 in the centralizer hub 2 of the assembled multi-unit centralizer 1. As illustrated in FIG. 3, the assembled multi-unit centralizer 1 preferably has a diameter which is substantially equal to or less than that of the couplings 27 used to connect the tubing string segments 26 to each other in the tubing string 25, as indicated by the dashed lines.

Figure 5:
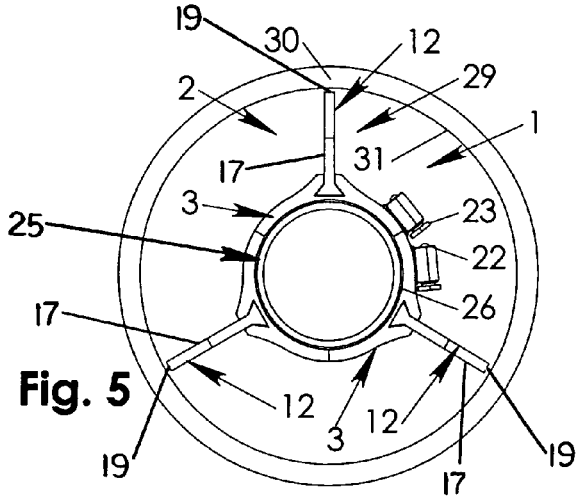
FIG. 5 is a top view of a tubing string extending into a well bore, with the multi-unit centralizer mounted on the tubing string and centralizing the tubing string in the well bore.

After the multi-unit centralizer 1 is assembled on the tubing string 25 in the manner heretofore described, the tubing string 25 is lowered into the well bore 29, as illustrated in FIG. 2. As illustrated in FIGS. 2 and 5, the outer edge 19 of the lug blade 17 on each spacer lug 12 contacts the interior surface of the well casing 30 and maintains the tubing string 25 in spaced relationship with respect to the well casing 30. Accordingly, an annulus 31 is defined between the tubing string 25 and the well casing 30, through which annulus 31 packing material 32, for example, may be passed to stabilize the tubing string 25 in the well bore 29, as illustrated in FIG. 2. When the tubing string 25 is in place in the well bore 29, water, oil or gas is pumped from the bottom of the well bore 29, through the tubing string 25 and to the ground surface, typically for use in homes or businesses.

As heretofore described with respect to FIGS. 4 and 9–11, the size of the spacer lugs 12 attached to the centralizer hub 2 is selected based on the diameter of the well bore 29 to ensure centralization or off-center positioning of the tubing string 25 in the well bore 29. In those cases in which the tubing string 25 is to be centralized in the well bore 29, spacer lugs 12 of equal size are attached to the centralizer hub 2, as illustrated in FIGS. 4 and 5. Alternatively, in the event that off-center positioning of the tubing string 25 in the well bore 29 is deemed necessary, as illustrated in FIGS. 6 and 7, spacer lugs 12*a*, 12*b*, 12*c* of different sizes may be attached to the centralizer hub 2 for the purpose, as heretofore described.

Each of the multi-unit centralizers 1 may be removed from the tubing string 25, as needed, by loosening the fastener 23 in the fastener socket 22 of each band clamp 20 and detaching one end of the band 21 from the fastener socket 22; removing the band 21 from the corresponding set of clamp grooves 9, band slots 7*a* and clamp slots 16, respectively, and disengaging the hub subunits 3 from the tubing string 25 and from each other. The spacer lugs 12 can be removed from each corresponding hub subunit 3 typically by sliding the lug flange 13 of each spacer lug 12 from the corresponding flange groove 6 of the hub subunit 3.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above,

I claim:

1. A multi-unit centralizer comprising:

a centralizer hub including a plurality of hub subunits removably engaging each other;

an elongated flange groove having at least one open end provided in each of said plurality of hub subunits; and at least one spacer lug slidably and removably engaging each of said plurality of hub subunits by inserting said at least one spacer lug into said at least one open end and sliding said at least one spacer lug in said flange groove.

2. The multi-unit centralizer of claim 1 further comprising at least one flange groove provided in said each of said plurality of hub subunits and a lug flange carried by said at least one spacer lug and slidably engaging said at least one flange groove.

3. The multi-unit centralizer of claim 1 further comprising at least one clamp removably engaging said plurality of hub subunits and said at least one spacer lug to secure said plurality of hub subunits in said centralizer hub and said at least one spacer lug on said plurality of hub subunits, respectively.

4. The multi-unit centralizer of claim 3 further comprising at least one flange groove provided in said each of said plurality of hub subunits and a lug flange carried by said at least one spacer lug and slidably engaging said at least one flange groove.

5. The multi-unit centralizer of claim 3 further comprising at least one clamp groove provided in each of said plurality of hub subunits and wherein said at least one clamp is seated in said at least one clamp groove, respectively.

6. The multi-unit centralizer of claim 5 further comprising at least one flange groove provided in each of said plurality of hub subunits and a lug flange carried by said at least one spacer lug and slidably engaging said at least one flange groove.

7. The multi-unit centralizer of claim 3 further comprising at least one clamp slot provided in each of said at least one spacer lug and wherein said at least one clamp extends through said at least one clamp slot.

8. The multi-unit centralizer of claim 7 further comprising at least one clamp groove provided in each of said plurality of hub subunits and aligned with said at least one clamp slot and wherein said at least one clamp is seated in said at least one clamp groove and extends through said at least one clamp slot, respectively.

9. The multi-unit centralizer of claim 2 wherein said at least one flange groove comprises at least one dovetail flange groove and said at least one spacer lug comprises a lug blade and said lug flange comprises a dovetail lug flange carried by said lug blade, said dovetail lug flange having flange wings and a flange face extending between said flange wings.

10. The multi-unit centralizer of claim 9 further comprising at least one clamp removably engaging said plurality of hub subunits and said at least one spacer lug to secure said plurality of hub subunits in said centralizer hub and said at least one spacer lug on said plurality of hub subunits, respectively.

11. The multi-unit centralizer of claim 10 further comprising at least one clamp groove provided in each of said plurality of hub subunits and wherein said at least one clamp is seated in said at least one clamp groove, respectively.

12. The multi-unit centralizer of claim 11 further comprising at least one clamp slot provided in each of said at least one spacer lug and wherein said at least one clamp extends through said at least one clamp slot.

13. A multi-unit centralizer comprising:

an elongated centralizer hub having a longitudinal axis and including a plurality of hub subunits for removably engaging each other;

a flange groove provided in each of said plurality of hub subunits;

a plurality of spacer lugs capable of removably and interchangeably engaging said centralizer hub, each of said plurality of spacer lugs having an attachment edge capable of engaging said centralizer hub by sliding said attachment edge in said flange groove in a direction parallel to said longitudinal axis and an outer edge spaced from said attachment edge, defining a radial dimension between said attachment edge and said outer edge; and wherein said plurality of spacer lugs comprises a group of spacer lugs including at least a first set of spacer lugs having a first radial dimension and a second set of spacer lugs having a second radial dimension smaller than said first radial dimension, with at least three of said plurality of spacer lugs selected from said group of spacer lugs and removably engaging said centralizer hub.

14. The multi-unit centralizer of claim 13 further comprising at least one flange groove provided in each of said plurality of hub subunits and a lug flange carried by each of said plurality of spacer lugs for slidably engaging said at least one flange groove.

15. The multi-unit centralizer of claim 14 further comprising at least one clamp for removably engaging said plurality of hub subunits and said at least three of said plurality of spacer lugs and securing said plurality of hub subunits in said centralizer hub and said at least three of said plurality of spacer lugs on said centralizer hub.

16. The multi-unit centralizer of claim 15 further comprising at least one clamp groove provided in each of said plurality of hub subunits for receiving said at least one clamp, respectively, and at least one clamp slot provided in each of said plurality of spacer lugs for receiving said at least one clamp.

17. The multi-unit centralizer of claim 13 wherein said plurality of spacer lugs further comprises a third set of spacer lugs having a third radial dimension intermediate in size between said first radial dimension and said second radial dimension.

18. A multi-unit centralizer comprising:

a centralizer hub including a plurality of hub subunits removably attached to each other, said plurality of hub subunits each having at least one clamp groove for alignment with said at least one clamp groove of an adjacent one of said plurality of hub subunits in said centralizer hub;

a flange groove having at least one open end provided in each of said plurality of hub subunits;

a plurality of spacer lugs slidably and removably engaging said centralizer hub by insertion in said at least one open end of said flange groove, each of said plurality of spacer lugs having at least one clamp slot for alignment with said at least one clamp groove as said each of said plurality of spacer lugs slides along said centralizer hub; and at least one band clamp removably seated in said at least one clamp groove and extending through said at least one clamp slot for removably securing said plurality of hub subunits in said centralizer hub and said plurality of spacer lugs on said centralizer hub.

19. The multi-unit centralizer of claim 18 further comprising at least one flange groove provided in each of said plurality of hub subunits and a lug flange carried by each of said plurality of spacer lugs for slidably engaging said at least one flange groove, and wherein said at least one clamp slot extends through said lug flange.

20. The multi-unit centralizer of claim 18 wherein each of said plurality of spacer lugs comprises a lug blade carried by said lug flange, said lug blade having an outer edge spaced from said lug flange and defining a radial dimension extending between said outer edge and said lug flange; and wherein said plurality of spacer lugs comprises at least a first set of spacer lugs having a first radial dimension and a second set of spacer lugs having a second radial dimension smaller than said first radial dimension.

21. The multi-unit centralizer of claim 20 wherein said plurality of spacer lugs further comprises a third set of spacer lugs having a third radial dimension intermediate in size between said first radial dimension and said second radial dimension.

22. A method of positioning a tubing string in a well bore, comprising:

providing a multi-unit centralizer comprising a centralizer hub having a plurality of hub subunits for removably engaging each other and a plurality of spacer lugs for removably engaging said centralizer hub, said plurality of hub subunits each having a longitudinal axis;

providing said plurality of spacer lugs on said centralizer hub by sliding at least one of said plurality of spacer lugs on each of said plurality of hub subunits along said longitudinal axis;

assembling said centralizer hub on the tubing string by causing engagement of said plurality of hub subunits to each other; and lowering the tubing string and said centralizer into the well bore.

23. The method of claim 22 wherein said plurality of spacer lugs comprises at least a first set of spacer lugs having a first radial dimension and a second set of spacer lugs having a second radial dimension smaller than said first radial dimension, and wherein said providing said plurality of spacer lugs on said centralizer hub comprises selecting at least three spacer lugs from said plurality of spacer lugs and providing said at least three spacer lugs on said centralizer hub.

24. The method of claim 23 wherein said plurality of spacer lugs further comprises a third set of spacer lugs having a third radial dimension intermediate in size between said first radial dimension and said second radial dimension.

25. The method of claim 23 wherein said selecting at least three spacer lugs from said plurality of spacer lugs comprises selecting at least three spacer lugs from one of said first set of spacer lugs and said second set of spacer lugs.

26. The method of claim 24 wherein said selecting at least three spacer lugs from said plurality of spacer lugs comprises selecting at least one spacer lug from said first set of spacer lugs, at least one spacer lug from said second set of spacer lugs, and at least one spacer lug from said third set of spacer lugs.

* * * * *